United States Patent [19]

Osinga

[11] Patent Number: 4,692,731

[45] Date of Patent: Sep. 8, 1987

[54] COMPOSITE WIRE, COIL AND DEFLECTION UNIT FOR HF APPLICATIONS

[75] Inventor: Halbe Osinga, Eindhoven, Netherlands

[73] Assignee: U.S. Philips Corporation, New York, N.Y.

[21] Appl. No.: 847,988

[22] Filed: Apr. 3, 1986

[30] Foreign Application Priority Data

Apr. 4, 1985 [NL] Netherlands ..... 8500993
Feb. 12, 1986 [NL] Netherlands ..... 8600341

[51] Int. Cl.[4] ..... H01F 5/00
[52] U.S. Cl. ..... 335/299; 335/213; 174/114 R
[58] Field of Search ..... 335/210, 213, 299; 174/114 R

[56] References Cited

U.S. PATENT DOCUMENTS 4,549,042 10/1985 Akiba et al. ..... 174/114 R

*Primary Examiner*—George Harris
*Attorney, Agent, or Firm*—Thomas A. Briody; jack Oisher; William J. Streeter

[57] ABSTRACT

A composite wire which consists of a number of preferably parallel extending single wire strands bundled to form one solid assembly at least one of which is a bare wire. The composite wire (8) is formed from a bare wire (15) around whch a number, for example, five, or more, single wire strands (9–14) having a thin insulating layer are arranged in the form of a bundle. The assembly is surrounded by a layer of an electrically insulating material, which itself may be surrounded by a layer of a thermoplastic material. The composite wire is particularly suitable for winding saddle-shaped deflection coils for deflection units for cathode ray tubes.

13 Claims, 5 Drawing Figures

COMPOSITE WIRE, COIL AND DEFLECTION UNIT FOR HF APPLICATIONS

BACKGROUND OF THE INVENTION

1. Field of the Invention

The invention relates to a composite wire for high-frequency applications comprising a number of single wire strands of an electrically conductive material insulated from each other. Composite wires are used in electronics for winding high frequency coils.

2. Description of the Related Art

A high resolution display consisting of a display tube having a deflection unit in which the deflection coil is wound from Litz wire, consisting of 35 thin twisted single wire strands, is disclosed, for example in "Journal of the electronics Ind." January 1985, p. 64. The use of a composite wire instead of a single wire has for its object to reduce the eddy currents occurring during operation of the deflection coils at high frequencies. The presence of eddy currents causes an inadmissible heating of the deflection coils.

Besides the advantage of the reduction of eddy currents, the conventional composite (Litz) wire, however, also has certain disadvantages. The manufacture of said wire requires the use of rather complicated machines. Moreover, the conductor cross-section (the filling factor) of a Litz wire is substantially smaller than the conductor cross-section of a single (solid) wire of the same diameter. The lower filling factor means a higher ohmic resistance.

SUMMARY OF THE INVENTION

It is one object of the invention to provide a composite wire of the type mentioned in the opening paragraph which is simple to manufacture and the filling factor of which is as nearly equal to that of a single wire as much as possible.

This object is achieved by a composite wire which is characterized in that it comprises at least one bare wire strand in addition to a plurality of single wire strands with a thin insulating layer, the single wires having along the length of the composite wire previously determined positions with respect to each other and being bundled to form a solid assembly which is enveloped by a layer of an electrically insulating material. Within the scope of the invention the single wire strands may show a regular pitch, the pitch depending on the use and the diameter. In a practical case the pitch was between 1 twist per cm and 1 twist per 25 cm. The positions of the single wire strands with respect to each other, however, can be fixed very favourably by causing the single wire strands according to an ambodiment of the invention to extend in parallel.

By ensuring that the single wire strands extend in previously determined parallel positions with respect to each other parallel to the length of the composite wire, one or more bare wires (not comprising an insulating layer) may be used in the composite wire according to the invention. This leads to an increase of the cross-section of the conductor without this influencing the outside diameter. As a result of this it is possible to satisfy the requirement that the conductor cross-section be as nearly equal as possible to that of a single wire strand of the same outside diameter. In particular it is possible to realize a composite wire having a conductor cross-section which is not more than 20% smaller than that of a solid wire of the same outside diameter. In general this is not possible with a Litz wire.

Within the scope of the invention, a number of different configurations of bundled single wire strands are possible. Those configurations are preferred in which the bundle is constructed from a single wire strand around which the remaining single strands are arranged in a bunch. Such configurations deviate least from the circular shape favourable for windability. However, it should be ensured in all cases that the single wire strands readily engage each other from the beginning up to their ends (constant outside diameter).

In the case of a central wire strand around which the further single wire strands are arranged in the form of a bunch, it is advantageous in connection with the requirement of minimum breakdown between adjoining composite strands that the central wire strand is a bare wire and the remaining single wire strands comprise a thin insulating layer.

Composite wire configurations tested successfully in practice are those in which the central bare wire strand is surrounded by at least five, preferably six, single wire strands in the form of a bunch. The configurations of core wire with five bunched wires or of core wire having six bunched wires (in the latter case the core wire diameter is equal to the diameter of the bunched wires) have the advantage of being easier to manufacture. Configurations of core wire with a greater number of bunched wires (in which the core wire diameter is greater than the diameter of the bunched wires) have the advantage of a larger conductor cross-section with the same outside diameter as well as a better approach of the circular shape.

In all cases the rise in temperature of deflection coils manufactured from thses composite wires when energised at frequencies between 16 and 100 kHz remained within acceptable limits.

The single wire strands may be combined to form a solid unit in various manners.

A first manner is that the surrounding wire strands are adhered to the core wire strand. For that purpose the bare core wire strand may be provided, for example, with an adhesive in the form of a thermoplastic outer layer.

A second manner is that the single wire strands as a whole are enveloped by an insulating lacquer. In order to achieve this they may be drawn through an enamelling furnace whilst supplied in the correct configuration.

An advantage of the second manner is that the conductor cross-section is larger. The diameter of the core wire strand may be equal to the overall diameter of the core wire strand with a layer of adhesive in the first manner.

Independently of the manner in which the single wire strands have been combined to form a solid assembly, the multiple wires, when used in deflection coils of the saddle type, comprise an outer envelope of a thermoplastic material.

The invention also relates to a coil which is wound from a composite wire of the above-described type. Such a coil may be used advantageously, for example, in switched supplies, in linearity correctors, in bridge coils, in motors which are to be driven accurately and in deflection units. In the latter case the (deflection) coil may be wound toroidally on the yoke ring of the deflection unit, or may be of the self-supporting saddle type. In the cases mentioned hereinbefore it may be advantageous when the composite wire is surrounded by an outer envelope of a thermoplastic material. In the case in which a self-supporting coil is to be wound from the composite wire, such an envelope is essential. An example of a self-supporting coil is a deflection coil of the saddle type. The invention relates in particular to a deflection unit for a cathode ray tube having at least one pair of deflection coils of the saddle-type which are wound from a composite wire of the above-described type.

As a matter of fact conventional Litz wire is not so suitable for various reasons for winding deflection coils of the saddle type. This holds in particular if the present-day winding techniques (and the present-day winding machines) which are used for winding deflection coils of the saddle-type from a single-wire strand are also to be used for winding the deflection coils of the saddle-type from a composite wire. Wires thinner than 0.2 mm can easily get wedged between the die and the wall of the winding jig, resulting in breakdown (the insulation is damaged) or even wire fracture. It makes no difference whether the single wires are would individually or in the form of Litz (several wire strands twisted together to form one bunch) in the jig.

In order to be workable on the present-day winding machines a composite wire should moreover have an overall diameter which differs as little as possible from the diameter of the single wire whose place it is to take. A thicker wire presents problems upon filling in the jig. These problems are solved by using the composite wire described hereinbefore.

BRIEF DESCRIPTION OF THE DRAWINGS

A few embodiments of the invention will now be described in greater detail with reference to the accompanying drawings, wherein.

DESCRIPTION OF THE PREFERRED EMBODIMENTS

Figure 1:
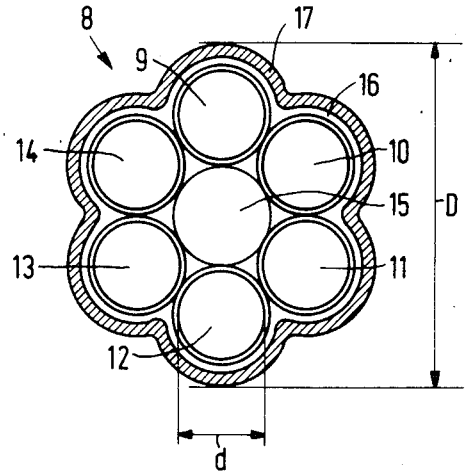
FIG. 1 is a cross-sectional view through a composite winding wire constructed from seven single wire strands.

FIG. 1 is a cross-sectional view through a composite wire 8 having seven single wire strands.

The wires 9–14 consist of copper and have a diameter d of, for example, 120 μm and are each provided with an insulating envelope, for example, of polyurethane or polyester imide, having a thickness of, for example, 6 μm. The six insulated wires 9–14 surround a central bare wire 15 having a diameter of, for example, 132 μm in the form of a bunch. The parallel extending wires 9–15 are combined to form a composite assembly by means of a layer of an adhesive 16, for example, also of polyurethane. The assembly is surrounded by an envelope 17 of a synthetic resin.

The thickness of each the insulating envelope of the single wires 9–14 may be small because the voltage between the single wires of a composite wire segment is small. (The requirement for the minimum breakdown between the single wires mutually is, for example, 100 V). The voltage between adjoining segments of a composite wire used in a deflection coil is much larger and the normal insulation value should be maintained. (The requirement for the minimum breakdown between adjacent composite wire segments is, for example, 3000 V). In such a case it is advantageous for the composite wire to be surrounded by a layer of insulating material plus a layer of a thermoplastic material.

Figure 2:
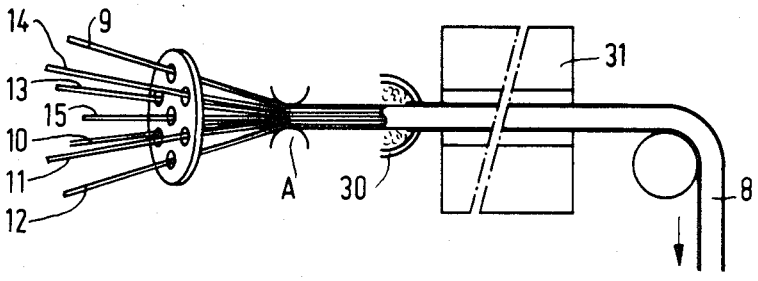
FIG. 2 shows diagrammatically the manufacture of the composite wire shown in the cross-sectional view of FIG. 1.

FIG. 2 shows diagrammatically the manufacture of the composite wire shown in the cross-sectional view of FIG. 1. The single wires are supplied in the correct configuration at point A and are then passed successively through a lacquer jet 30 and an enamel furnace 31.

An alternative method of bundling is to provide an adhesive layer, for example, a layer of a thermoplastic resin (material) around the core wire 15 and bundling the wires by heating instead of by means of the lacquer jet and enamel furnace. In that case the core wire 15 has a diameter which is smaller than 132 microns, for example 112 microns, in the case in which the adhesive layer has a thickness of 10 microns.

Figure 3:
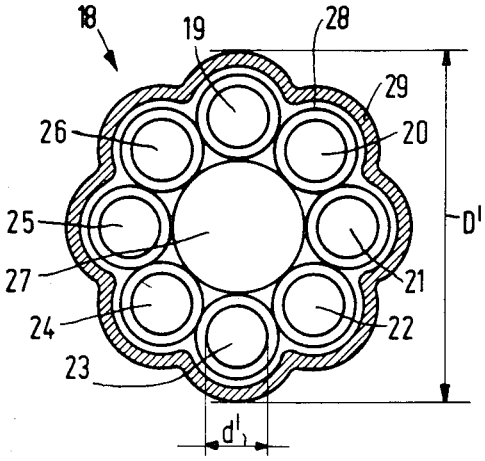
FIG. 3 is a cross-sectional view through a composite winding wire which is constructed from nine single wire strands.

FIG. 3 is a cross-sectional view through a composite winding wire 18 having nine single wire strands. The wires 19–26 consist of copper and have a diameter d' of 100 microns and are provided with an insulating layer of polyurethane having a thickness of 6 microns. The wires 19–26 surround a central bare wire 27 having a diameter of 180 microns in the form of a bunch. The nine parallel extending wires 19–27 are combined to form a solid assembly by means of a layer of lacquer 28. The assembly is enveloped by a thermoplastic envelope 29, for example of a phenoxy resin.

Figure 5:
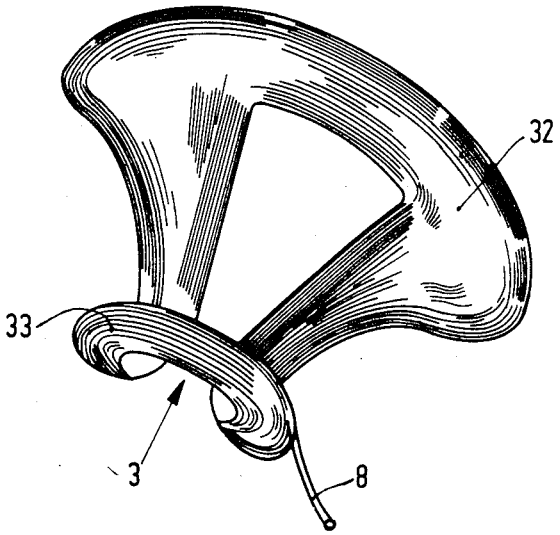
FIG. 5 shows a deflection coil.

The diameters D and D' of the composite wires shown in the cross-sectional views of FIGS. 3 and 5 correspond to the diameters of the single wire frequently used in the present-day winding machines (diameter copper wire 355 microns, thickness insulating layer approximately 20 microns, thickness thermoplastic envelope 8.5 microns; overall diameter 412 microns) and varies from 408 to 418 microns. However, the invention is not restricted to the use of composite sires having these diameters.

Figure 4:
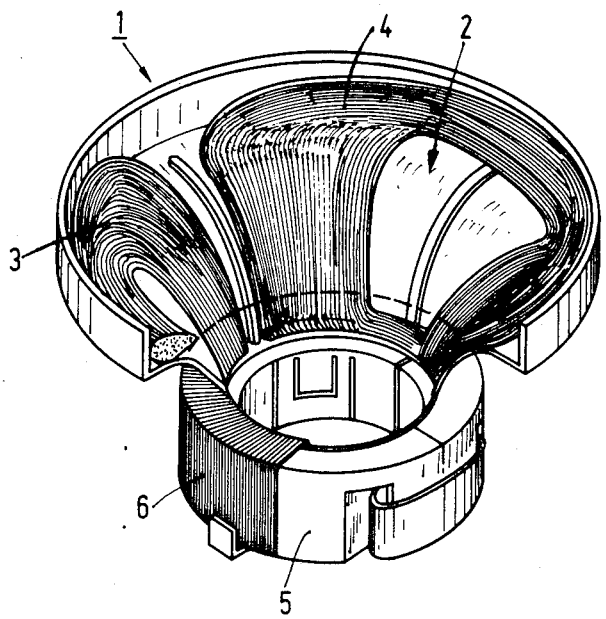
FIG. 4 shows a deflection unit for a cathode ray tube.

FIG. 4 shows a deflection unit 1 for a cathode ray tube which comprises a synthetic resin support 2 which on its inside supports a pair of deflection coils 3, 4 and on its outside supports an annular core 5 of a magnetisable material on which a pair of deflection coils 6, 7 (deflection 7 is not visible) is wound toroidally. Deflection coil 3 which is of the self-supporting, so-called saddle-type is shown separately in FIG. 5. It is to be noted that FIG. 5 shows a self-supporting deflection coil 3 having a front flange 32 which faces the display screen during operation, and a rear flange 33 which is directed away from the display screen during operation. However, the invention also relates to self-supporting deflection coils having only a front flange. Deflection coils 3 as well as deflection coils 4, are wound according to the invention from a composite wire 8 of the type described hereinbefore. The bunched single wires thereof are surrounded by a thermoplastic envelope 17 which may consist, for example, of butyral, of a modified epoxy resin, or of nylon. This thermoplastic envelope 17 serves to bond the adjoining segments of the winding wire together as soon as these have been wound to a given pattern to form a deflection coil (FIG. 5) to fix the shape of the resulting deflection coil in this manner. For that purpose, when the coil is still in the winding jig, a current is usually passed through the winding wire to heat the coil to a temperature at which the thermoplastic envelope softens. The material of the thermoplastic envelope must satisfy the requirement that the softening temperature should be higher than the temperature which the deflection coils reach during operation. These temperatures are, for example, 200° and 95° C., respectively. After cooling in the jig a "self-supporting" coil as shown in FIG. 5 is obtained.

What is claimed is:

1. A composite wire for high-frequency applications, comprising: at least one bare wire strand and a plurality of single wire strands of electrically conductive material; each of the single wire strands having a thin insulating layer and extending in pre-determined parallel positions with respect to each other and parallel to the length of the composite wire; all of said wire strands being bundled to form a solid assembly; and a layer of electrically insulating material enveloping such solid assembly.

2. A composite wire as claimed in claim 1, characterized in that the single wire strand extend in parallel.

3. A composite wire as claimed in claim 2, characterized in that the single wire strands are arranged in a bundle around the bare wire strand at the center of such bundle.

4. A composite wire as claimed in claim 3, characterized in that there are at least five of the single wire strands.

5. A composite wire as claimed in claim 3, characterized in that the single wire strands are bundled to form one assembly by means of a layer of lacquer.

6. A composite wire as claimed in claim 1, characterized in that the composite wire has a conductor cross-section which is at most 20% smaller than the conductor cross-section of a single wire having the same outside diameter.

7. A coil wound from a composite wire as claimed in claim 1.

8. A cathode ray tube deflection coil of the saddle type wound from a composite wire, such composite wire comprising: at least one bare wire strand and a plurality of single wire strands of electrically conductive material; each of the single wire strands having a thin insulating layer and extending in pre-determined parallel positions with respect to each other and parallel to the length of the composite wire; all of said wire strands being bundled to form a solid assembly, and a layer of electrically insulating material enveloping such solid assembly.

9. A deflection unit as claimed in claim 8, characterized in that the single wire strands of the composite wire extend in parallel.

10. A deflection coil as claimed in claim 9, characterized in that the single wire strands are arranged in a bundle around the bare wire strand at the center of such bundle.

11. A deflection coil as claimed in claim 10, characterized in that there are at least five of the single wire strands.

12. A deflection unit as claimed in claim 10, characterized in that the single wires are bundled to form one assembly by means of a layer of lacquer.

13. A deflection unit as claimed in claim 8, characterized in that the composite wire has a conductor cross-section which is at most 20% smaller than the conductor cross-section of a single wire strand of the same outside diameter.

* * * * *